US005134983A

United States Patent [19]

Kusunoki et al.

[11] Patent Number: 5,134,983

[45] Date of Patent: Aug. 4, 1992

[54] FUEL CONTROL SYSTEM FOR ENGINE

[75] Inventors: Hideki Kusunoki; Kazutomo Sasaki; Tomoichirou Shimada; Toshiya Kan, all of Hiroshima, Japan

[73] Assignee: Mazda Motor Corporation, Hiroshima, Japan

[21] Appl. No.: 721,776

[22] Filed: Jun. 28, 1991

[30] Foreign Application Priority Data

Jun. 29, 1990 [JP] Japan ..... 2-171998

[51] Int. Cl.[5] ..... F02D 41/10

[52] U.S. Cl. ..... 123/492

[58] Field of Search ..... 123/478, 480, 492, 493, 123/486

[56] References Cited

U.S. PATENT DOCUMENTS

| | | | |
|---|---|---|---|
| 4,357,923 | 11/1982 | Hideg | 123/492 |
| 4,388,906 | 6/1983 | Sugiyama et al. | 123/492 |
| 4,454,847 | 6/1984 | Isomura et al. | 123/492 |
| 4,667,640 | 5/1987 | Sekozawa et al. | 123/492 |
| 4,817,571 | 4/1989 | Morita et al. | 123/492 |
| 4,852,538 | 8/1989 | Nagaishi | 123/492 |
| 4,903,668 | 2/1990 | Ohata | 123/480 |
| 4,905,653 | 3/1990 | Manaka et al. | 123/480 |
| 4,953,530 | 9/1990 | Manaka et al. | 123/492 |
| 4,995,366 | 2/1991 | Manaka et al. | 123/492 |

*Primary Examiner*—Willis R. Wolfe

*Attorney, Agent, or Firm*—Sixbey, Friedman, Leedom & Ferguson

[57] ABSTRACT

A fuel control system for an engine has a fuel injector which injects fuel into an intake manifold of the engine. A fuel injector controller determines the amount of fuel to be injected from the fuel injector so that the sum of the amount of the direct delivery part of the injected fuel which is directly fed to a combustion chamber of the engine from the injector and the amount of the drawn part fuel which has adhered to the well surface of the intake manifold, evaporates and then flows into the combustion chamber is a target amount of fuel to be actually fed to the combustion chamber and causes the fuel injector to inject the target amount of fuel. When the controller increases the amount of fuel to be injected during acceleration, the amount of part of fuel injected from the injector which part is robbed by the wall surface of the intake manifold near the injector and does not contribute to the air-fuel ratio in intake air fed to the combustion chamber during acceleration is estimated, and the fuel injector controller increases the amount of fuel increase by an amount corresponding to the estimated amount of the part of fuel which is robbed by the wall surface of the intake manifold near the injector and does not contribute to the air-fuel ratio in intake air fed to the combustion chamber.

5 Claims, 8 Drawing Sheets

FUEL CONTROL SYSTEM FOR ENGINE

BACKGROUND OF THE INVENTION

1. Field of the Invention

This invention relates to a fuel control system for an engine.

2. Description of the Prior Art

There has been known a fuel control system for an engine in which the amount of fuel fed to the engine is temporarily increased during acceleration.

For example, in the fuel control system disclosed in Japanese Unexamined Patent Publication No. 1(1989)-219325, fuel is normally injected from an injector every predetermined crank angle for a predetermined time (synchronous injection), and is injected from the injector for a predetermined additional time (asynchronous injection) during acceleration.

That is, in the control system, the amount of fuel fed to the engine is increased in expectation of increase in the amount of intake air when the change in the throttle opening is large (when the vehicle is being accelerated) so that the air-fuel ratio does not become lean during acceleration. However, since the amount of fuel fed to the combustion chamber is the sum of fuel directly fed to the combustion chamber from the injector and fuel which has adhered to the wall of the intake manifold, evaporates and then flows into the combustion chamber, and since almost all the fuel which has adhered to the wall of the intake manifold is caused to flow into the combustion chamber at the beginning of the acceleration due to high intake vacuum downstream of the throttle valve which has been there before depression of the accelerator and remains there for a short time after the depression of the accelerator due to delay in change of the intake vacuum, the air-fuel ratio cannot become lean at the beginning of the acceleration but, during the acceleration thereafter, part of the fuel injected from the injector adheres to the wall of the intake manifold and the air-fuel ratio can become too lean, whereby acceleration performance deteriorates.

SUMMARY OF THE INVENTION

In view of the foregoing observations and description, the primary object of the present invention is to provide a fuel control system for an engine in which the air-fuel ratio during acceleration is prevented from becoming too lean due to reduction in the amount of fuel on the wall of the intake manifold at the beginning of the acceleration.

In the fuel control system in accordance with the present invention, the amount of fuel to be injected from the injector is determined so that the sum of the amount of the part of the injected fuel which is directly fed to the combustion chamber from the injector and the amount of the fuel which has adhered to the wall of the intake manifold, evaporates and then flows into the combustion chamber is a target amount of fuel to be actually fed to the combustion chamber. Generally a part of the fuel injected from the injector in each intake stroke is directly fed to the combustion chamber in the intake stroke, and the other part of the fuel injected from the injector in the intake stroke adheres to the wall surface of the intake manifold. A part of the fuel which has adhered to the wall surface of the intake manifold evaporates and flows into the combustion chamber in the next intake stroke together with a part of the fuel injected from the injector in the next intake stroke. The part of the fuel injected from the injector in each intake stroke which is directly fed to the combustion chamber in the intake stroke will be referred to as "the direct delivery part" in this specification. The fuel which has adhered to the wall surface of the intake manifold will be referred to as "the intake manifold adhering fuel" and the part of the intake manifold adhering fuel which evaporates and flows into the combustion chamber will be referred to as "the drawn part" in this specification. That is, in the fuel control system in accordance with the present invention, the amount of fuel to be injected from the injector is basically determined so that the sum of the amount of the direct delivery part and the amount of the drawn part is a target amount of fuel to be actually fed to the combustion chamber. The amount of the drawn part is estimated on the basis of the estimated amount of the intake manifold adhering fuel, and accordingly, when the actual amount of the adhering fuel is smaller than the estimated amount of the same, the amount of fuel actually fed to the combustion chamber becomes smaller than the target amount of fuel. As described above, at the beginning of acceleration, the amount of the intake manifold adhering fuel is reduced due to change in the throttle opening, the flow rate of intake air and the like. Accordingly, in accordance with the present invention, when the amount of fuel to be injected from the injector is increased during acceleration, the increase of fuel is determined taking into account the reduction of the adhering fuel. Further, as the throttle opening increases and the boost increases during acceleration, fuel becomes more apt to adhere to the wall surface of the intake manifold and a large amount of fuel injected from the injector adheres to the wall surface of the intake manifold, whereby the amount of adhering fuel near the intake port which mainly contributes to the air-fuel ratio cannot be quickly recovered. Accordingly, in accordance with the present invention, the increase of fuel during acceleration is determined taking into account also the amount of fuel robbed by the wall surface of the intake manifold near the injector and does not contribute to the air-fuel ratio.

Thus, in accordance with the present invention, there is provided a fuel control system for an engine comprising a fuel injector which injects fuel into an intake manifold of the engine, an acceleration detecting means which detects that the engine is accelerated, and a fuel injector control means which determines the amount of fuel to be injected from the fuel injector so that the sum of the amount of the direct delivery part of the injected fuel which is directly fed to a combustion chamber of the engine from the injector and the amount of the drawn part fuel which has adhered to the wall surface of the intake manifold, evaporates and then flows into the combustion chamber is a target amount of fuel to be actually fed to the combustion chamber and causes the fuel injector to inject the target amount of fuel, the amount of the drawn part fuel being estimated on the basis of an estimated amount of intake manifold adhering fuel which has adhered to the wall surface of the intake manifold, and the fuel injector control means increasing the target amount of fuel when the acceleration detecting means detects that the engine is accelerated, wherein the improvement comprises that said fuel injector control means is provided with a means for estimating the amount of part of fuel injected from the injector which part is robbed by the wall surface of the intake manifold near the injector and does not contribute to the air-fuel ratio in intake air fed to the combustion chamber during acceleration, and the fuel injector control means increases the amount of fuel to be injected from the injector by an amount corresponding to the estimated amount of the part of fuel which is robbed by the wall surface of the intake manifold near the injector and does not contribute to the air-fuel ratio in intake air fed to the combustion chamber.

DESCRIPTION OF THE PREFERRED EMBODIMENT

Figure 1:
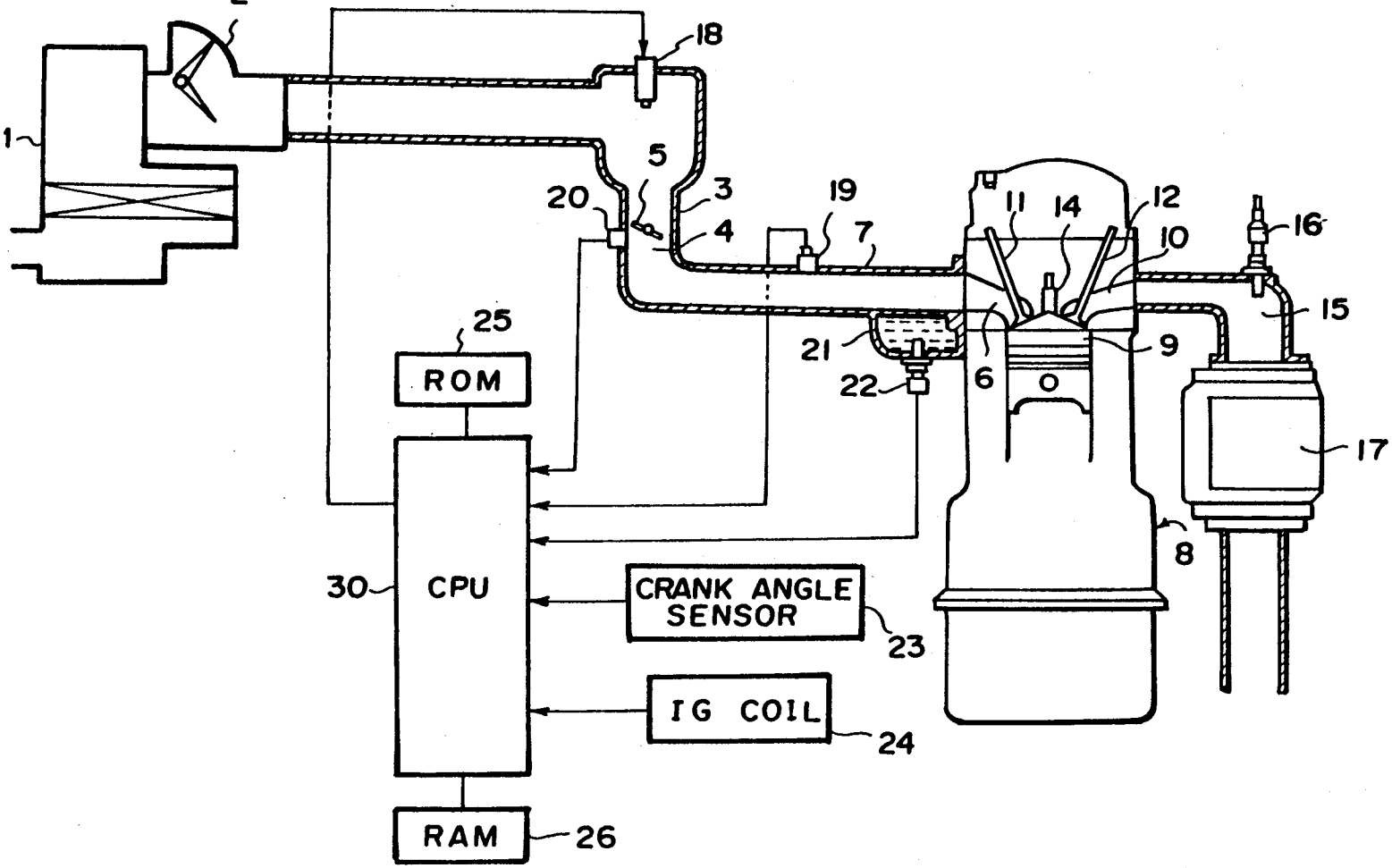
FIG. 1 is a schematic view of an engine provided with a fuel control system in accordance with an embodiment of the present invention.

In FIG. 1, a throttle body 3 is connected to an air cleaner 1 with an airflow meter 2 interposed therebetween. The throttle body 3 comprises an throttle chamber 4 and a throttle valve 5 disposed in the throttle chamber 4. An intake manifold 7 communicates the throttle valve chamber 4 with an intake port 6 of a combustion chamber 9 of an engine 8. The intake port 6 is provided with an intake valve 11. The combustion chamber 4 is communicated with an exhaust passage 15 by way of an exhaust valve 10. An catalytic converter 15 and an $O_2$ sensor 16 are provided in the exhaust passage 15. Reference numeral 14 denotes a spark plug.

A fuel injector 18 is provided upstream of the throttle valve 5 and a boost sensor 19 for detecting intake vacuum is provided downstream of the same. Further, a throttle sensor 20 detects the opening of the throttle valve 5.

An engine coolant temperature sensor 22 is mounted on a water jacket 21 around the intake manifold 7.

A part of the fuel injected from the injector 18 in each intake stroke is directly fed to the combustion chamber 9 in the intake stroke, and the other part of the fuel injected from the injector 18 in the intake stroke adheres to the wall surface of the intake manifold 7. A part of the fuel which has adhered to the wall surface of the intake manifold 7 evaporates and flows into the combustion chamber 9 in the next intake stroke together with a part of the fuel injected from the injector 18 in the next intake stroke. In the fuel control system in accordance with this embodiment, the amount of fuel to be injected from the injector 18 is basically determined so that the sum of the amount of the direct delivery part and the amount of the drawn part is a target amount of fuel to be actually fed to the combustion chamber 9. The amount of the drawn part is estimated on the basis of the estimated amount of the intake manifold adhering fuel, and accordingly, when the actual amount of the adhering fuel is smaller than the estimated amount of the same, the amount of fuel actually fed to the combustion chamber becomes smaller than the target amount of fuel. Accordingly, in this embodiment, when the amount of fuel to be injected from the injector is increased during acceleration, the increase of fuel is determined taking into account the reduction of the adhering fuel. Further, as the throttle opening increases and the boost increases during acceleration, fuel becomes more apt to adhere to the wall surface of the intake manifold 7 and a large amount of fuel injected from the injector 18 adheres to the wall surface of the intake manifold 7 near the injector 18, whereby the amount of adhering fuel near the intake port 6 which mainly contributes to the air-fuel ratio cannot be quickly recovered. Accordingly, in accordance with the present invention, the increase of fuel during acceleration is determined taking into account also the amount of fuel robbed by the wall surface of the intake manifold 7 near the injector 18 and does not contribute to the air-fuel ratio.

A CPU 30 receives a detecting signal of the boost sensor 19 which represents the intake vacuum ce, a detecting signal of the throttle sensor 20 which represents the throttle opening tvo, a detecting signal of the engine coolant temperature sensor 22 which represents the temperature of the engine coolant, a detecting signal of the crank angle sensor 23 which represents the crank angle cA and a signal from an ignition coil 24 which represents the engine speed Ne, and controls the injector 18 according to programs stored in a ROM 25 on the basis of these signals. Maps shown in FIGS. 2 to 13, a correction coefficient k for converting the result of calculation into a fuel injection pulse width, a fixed coefficient w, a basic fuel injection pulse width z, a basic fuel injection pulse width correction coefficient $\alpha$, a noneffective fuel injection pulse width $\beta$ and other required data are stored in a RAM 26.

Figure 14:
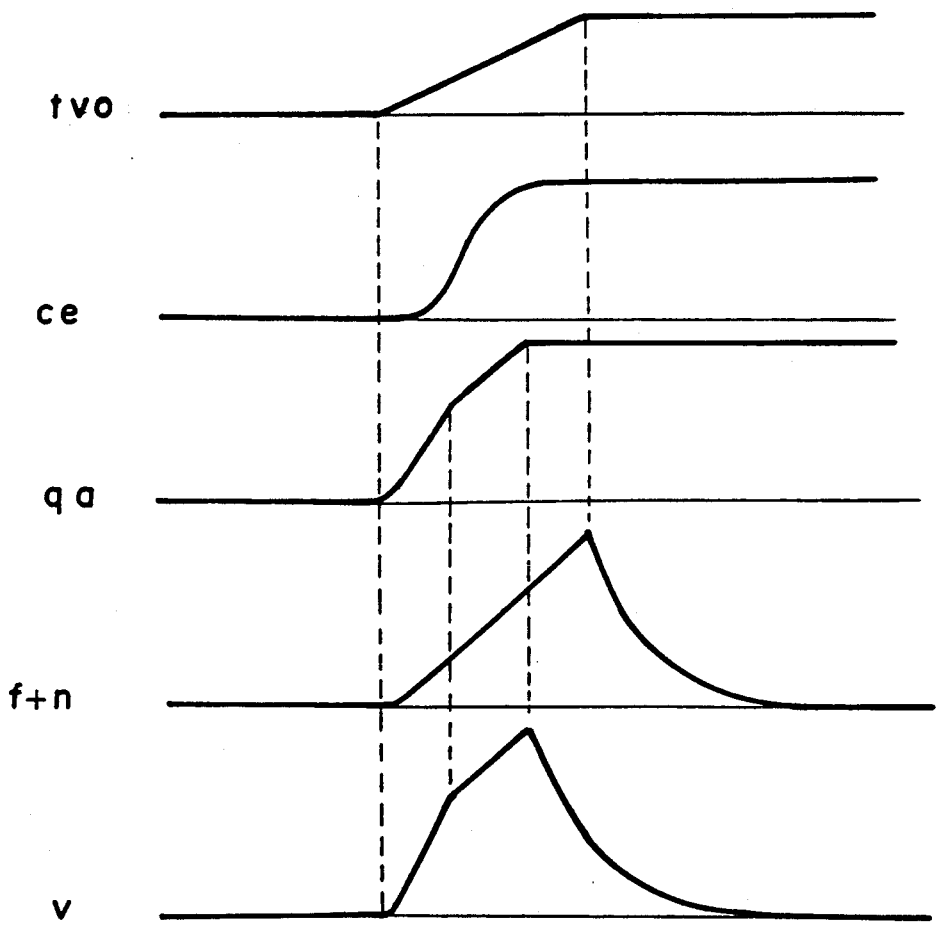
FIG. 14 is a time chart showing an example of change, during acceleration, in the throttle opening, the boost, the estimated amount of intake air, the correction value for correcting the amount of fuel increase according to increase in the amount of the adhering fuel, and the correction value for correcting the amount of fuel increase to compensate for the reduction of the adhering fuel at the beginning of acceleration.

Operation of the CPU 30 will be described with reference to the flow chart shown in FIG. 14.

Figure 2:
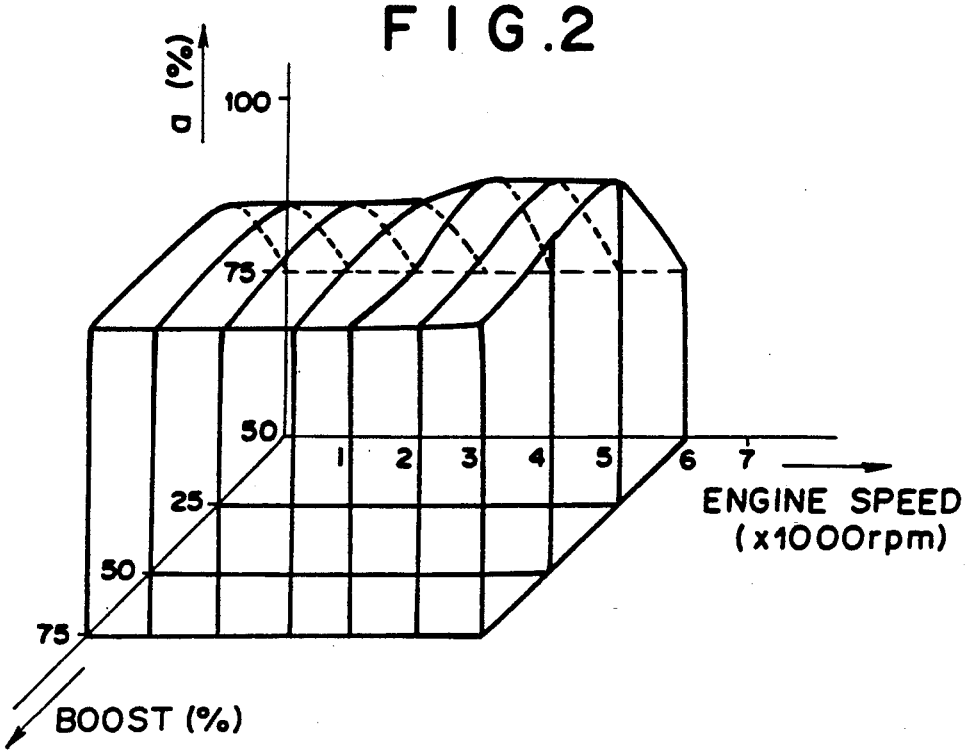
FIG. 2 is a three-dimensional map for determining the time constant for gradually reducing a correction value which corrects the amount of fuel increase according to increase in the amount of the adhering fuel estimated on the basis of the intake vacuum.

In step 31, the CPU 30 refers to the map shown in FIG. 2 and determines a time constant a for gradually reducing a correction value f which corrects the amount of fuel increase according to increase in the amount of the adhering fuel estimated on the basis of the intake vacuum ce. The purpose of the time constant a will become apparent later.

Figure 3:
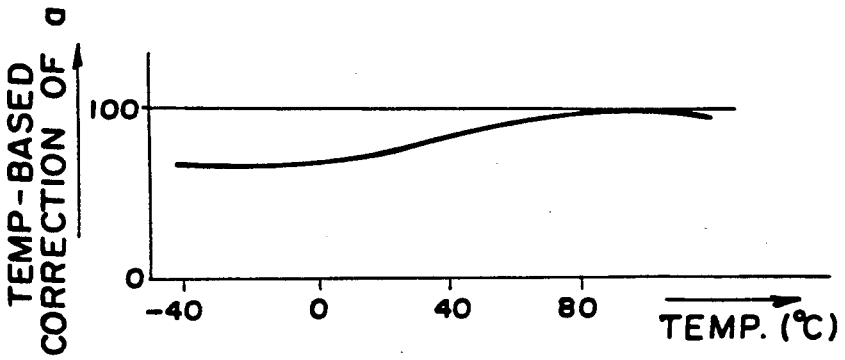
FIG. 3 is a map for correcting the time constant according to the temperature of the engine coolant.
Figure 4:
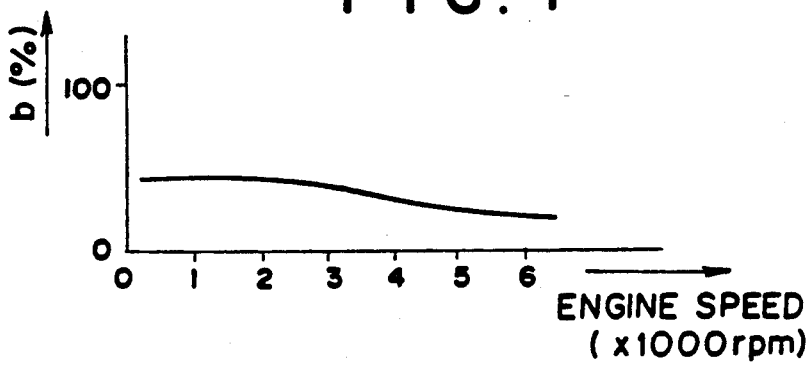
FIG. 4 is a map for correcting the time constant according to the engine speed.

Then in step 32, the CPU 30 determines an engine-speed-based correction value b referring to the map shown in FIG. 4, and calculates a coolant-temperature-based correction value which is related to the temperature of the engine coolant as shown in FIG. 3.

Figure 5:
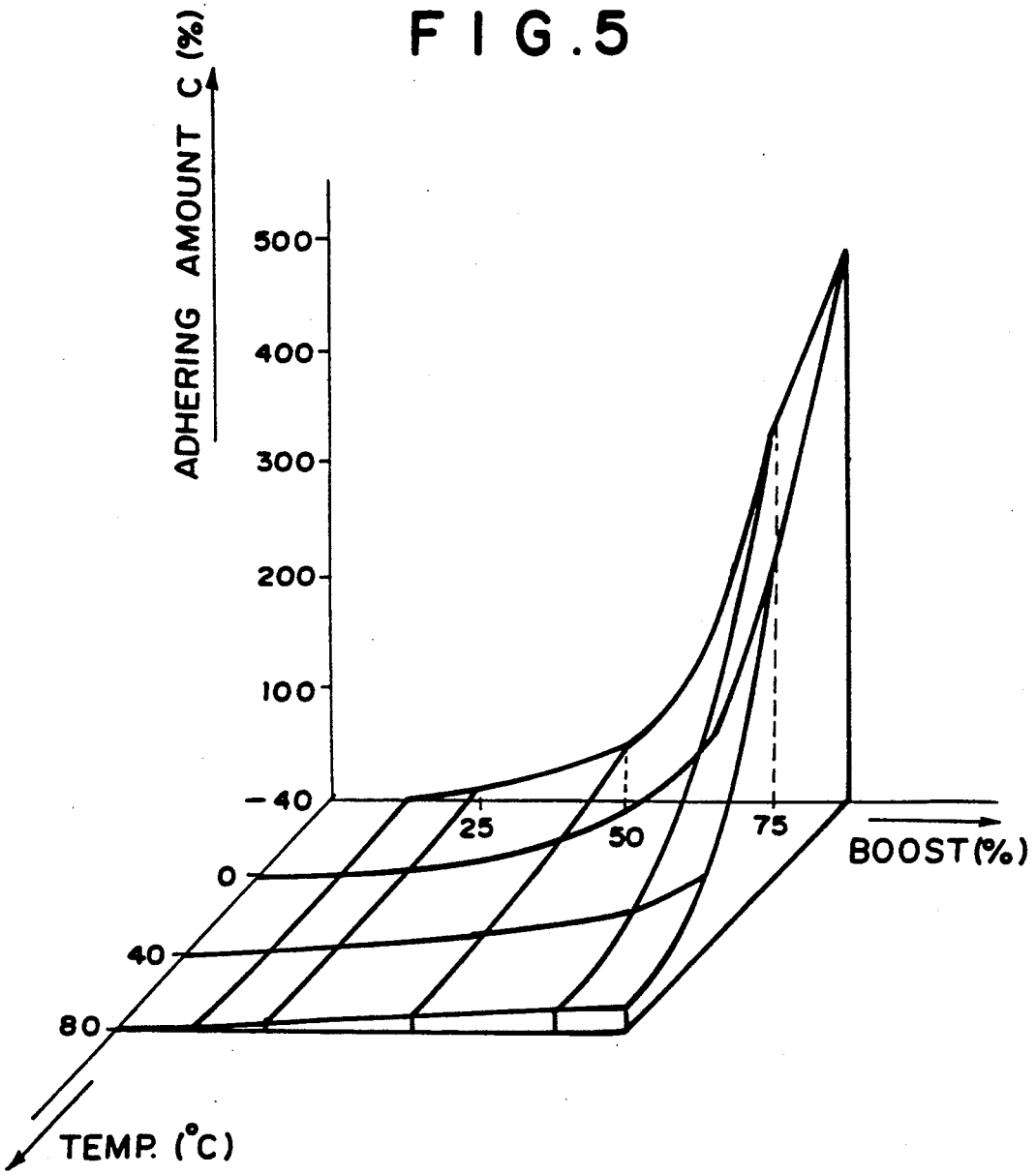
FIG. 5 is a three-dimensional map for determining the amount of the adhering fuel estimated on the basis of the intake vacuum.

The CPU 30 determines, referring to the map shown in FIG. 5, the present value of the amount of adhering fuel c which is estimated on the basis of the intake vacuum ce. (step 33) Thereafter, the CPU 30 substracts the preceding value C[i−1] of the amount of adhering fuel from the present value C[i] of the amount of adhering fuel and obtains a differential value d. (step 34)

The differential value d and differential values l and t which will be described later are positive only during acceleration.

In step 35, the CPU 30 obtains an addend e[i] by multiplying the present value d[i] of the differential value d calculated in step 34 by the correction coefficient k and the engine-speed-based correction value b.

Then in step 36, the CPU 30 obtains the present value f[i] of the correction value f by adding the addend e[i] to the preceding value f[i−1] of the correction value f.

Figure 6:
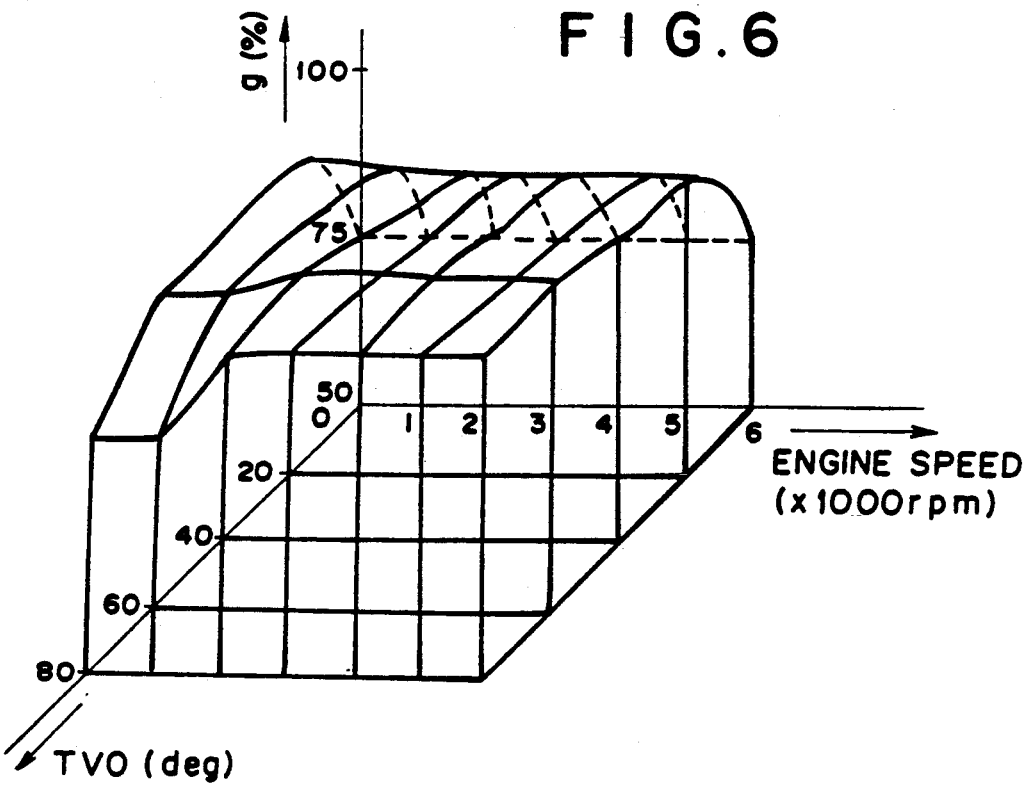
FIG. 6 is a three-dimensional map for determining the time constant for gradually reducing a correction value which corrects the amount of fuel increase according to increase in the amount of the adhering fuel estimated on the basis of the throttle opening.

Then in step 37, the CPU 30 refers the map shown in FIG. 6 and determines a time constant g for gradually reducing a correction value n which corrects the amount of fuel increase according to increase in the amount of the adhering fuel estimated on the basis of the throttle opening tvo. The purpose of the time constant g will become apparent later.

Figure 7:
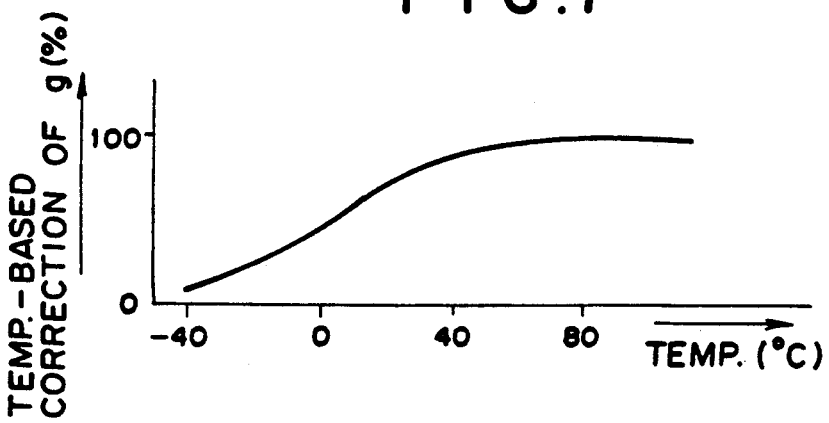
FIG. 7 is a map for correcting the time constant according to the temperature of the engine coolant.
Figure 8:
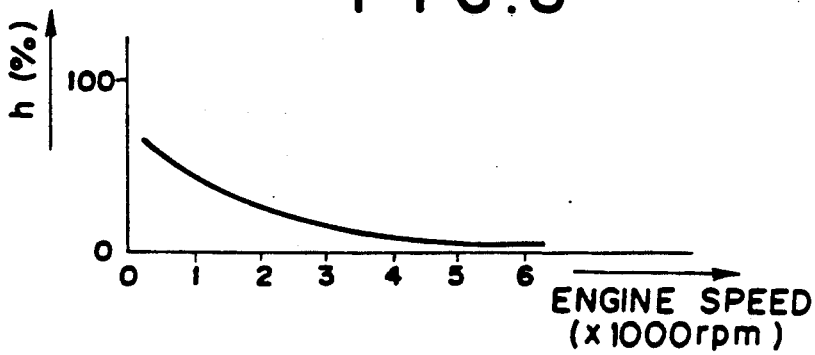
FIG. 8 is a map for correcting the time constant according to the engine speed.

Then in step 38, the CPU 30 determines an engine-speed-based correction value h referring to the map shown in FIG. 8, and calculates a coolant-temperature-based correction value which is related to the temperature of the engine coolant as shown in FIG. 7.

Figure 9:
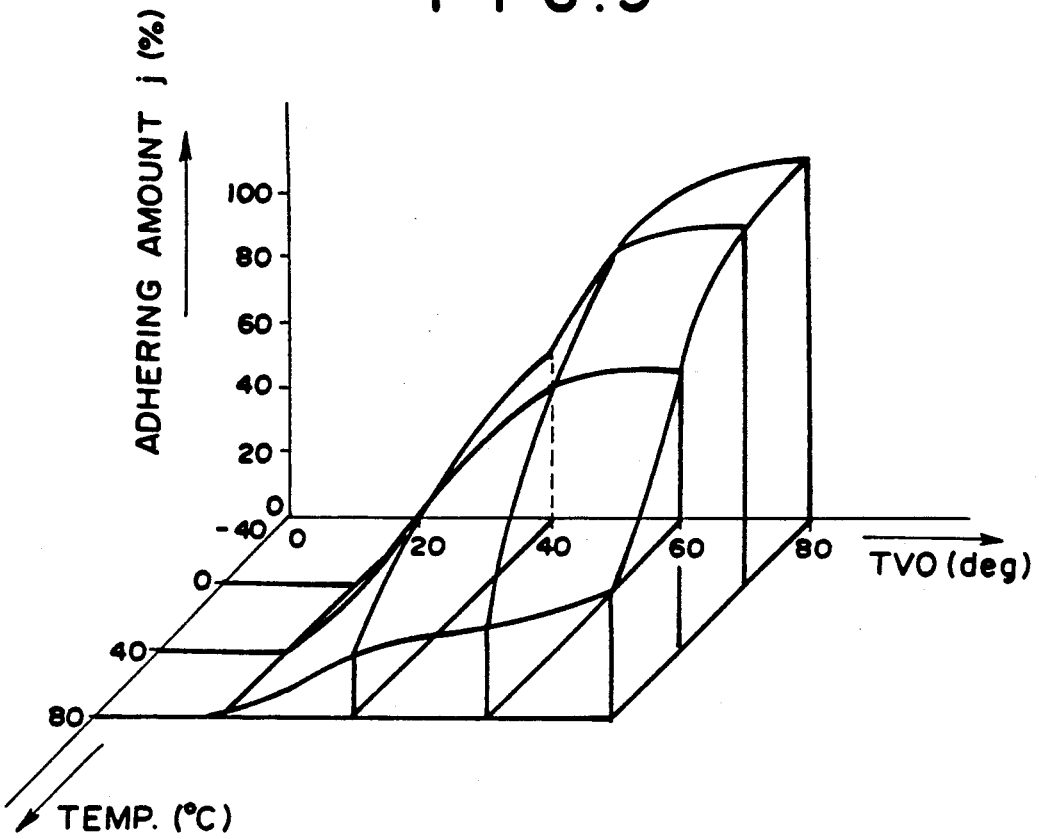
FIG. 9 is a three-dimensional map for determining the amount of the adhering fuel estimated on the basis of the throttle opening.
Figure 10:
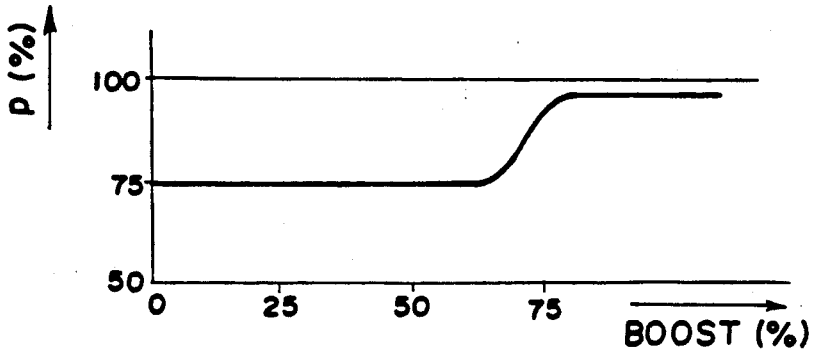
FIG. 10 is a map for determining the time constant for gradually reducing a correction value which corrects the amount of fuel increase to compensate for the reduction of the adhering fuel at the beginning of acceleration.

The CPU 30 determines, referring to the map shown in FIG. 9, the present value of the amount of adhering fuel j which is estimated on the basis of the throttle opening tvo. (step 39) Thereafter, the CPU 30 substracts the preceding value j[i−1] of the amount of adhering fuel from the present value j[i] of the amount of adhering fuel and obtains a differential value l. (step 40)

In step 41, the CPU 30 obtains an addend m[i] by multiplying the present value l[i] of the differential value l calculated in step 40 by the correction coefficient k and the engine-speed-based correction value h.

Then in step 42, the CPU 30 obtains the present value n[i] of the correction value n by adding the addend m[i] to the preceding value n[i−1] of the correction value n.

Further, in step 43, the CPU 30 refers to the map shown in FIG. 6 and determines a time constant p for gradually reducing a correction value v which corrects the amount of fuel increase to compensate for the reduction of the adhering fuel at the beginning of acceleration. The purpose of the time constant q will become apparent later.

Figure 11:
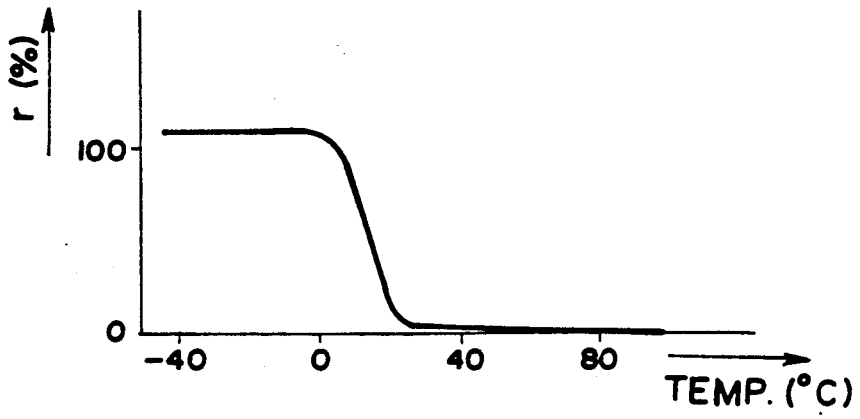
FIG. 11 is a map for correcting the time constant according to the temperature of the engine coolant.
Figure 12:
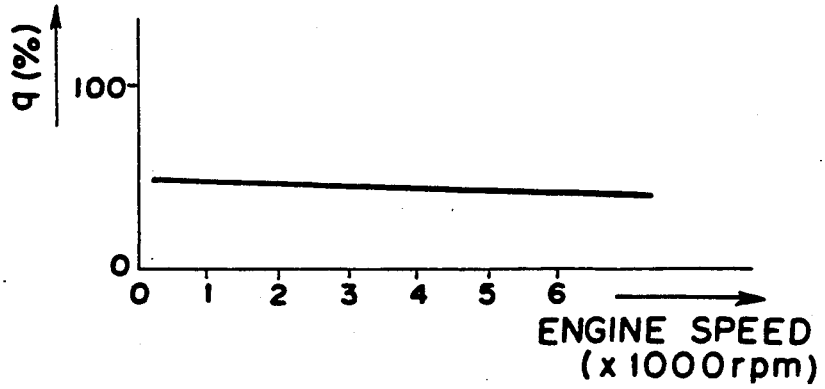
FIG. 12 is a map for correcting the time constant according to the engine speed.
Figure 13:
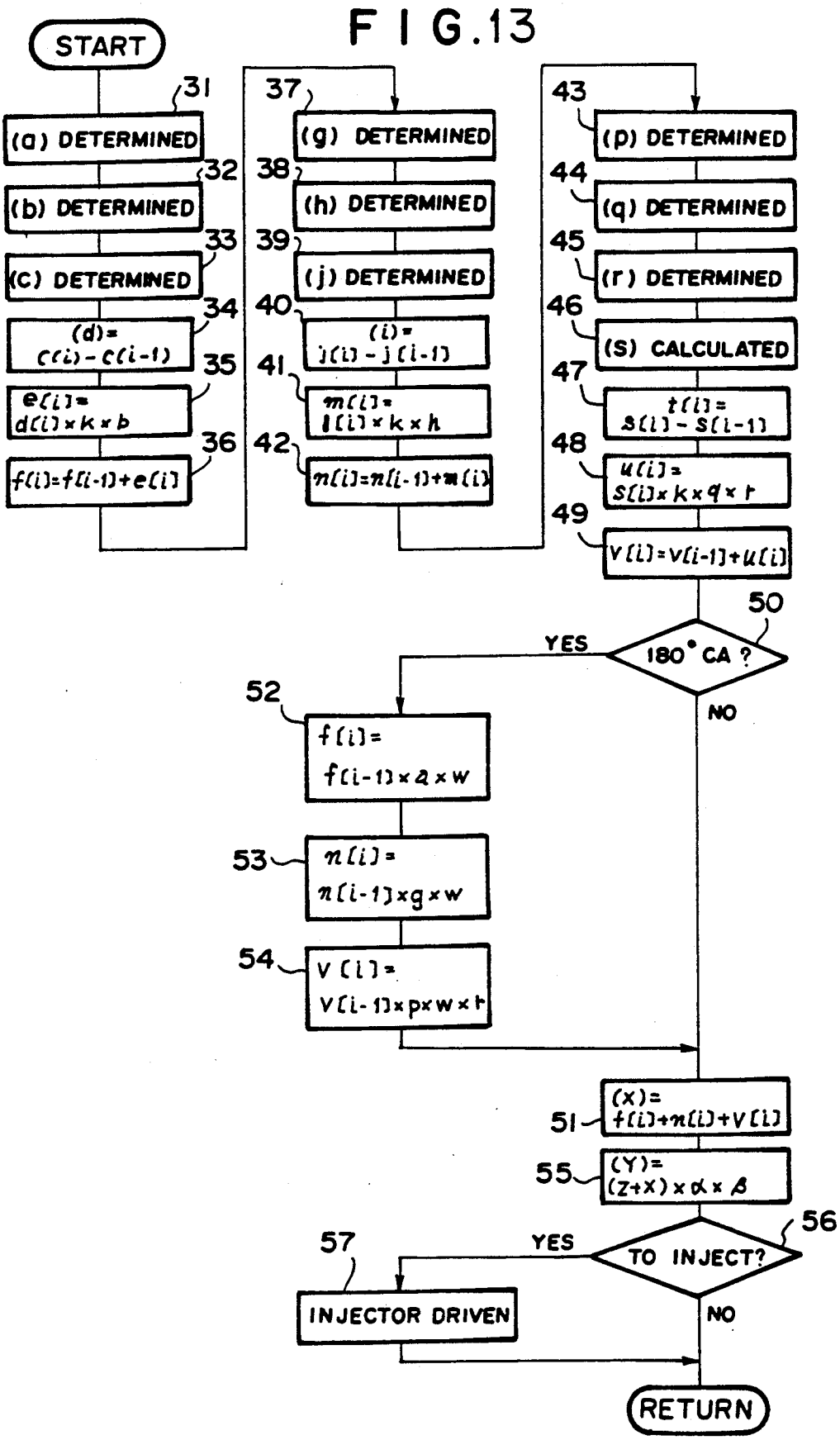
FIG. 13 is a flow chart for illustrating the operation of the CPU.

Then in step 44, the CPU 30 determines an engine-speed-based correction coefficient q referring to the map shown in FIG. 12, and in step 45, the CPU 30 determines a coolant-temperature-based correction value r referring to the map shown in FIG. 11.

Further, the CPU 30 estimates the amount of intake air qa on the basis of the engine speed Ne and the throttle opening tvo end calculates the charging efficiency s by dividing the amount of intake air qa by the present engine speed Ne. (step 46)

Thereafter, the CPU 30 substracts the preceding value s[i−1] of the charging efficiency from the present value s[i] of the same and obtains a differential value t. (step 47)

In step 4B, the CPU 30 obtains an addend u[i] by multiplying the present value t[i] of the differential value t calculated in step 47 by the correction coefficient k, the engine-speed-based correction value g and the coolant-temperature-based correction value r.

Then in step 49, the CPU 30 obtains the present value v[i] of the correction value v by adding the addend u[i] to the preceding value v[i−1] of the correction value v.

In step 50, the CPU determines whether the crank angle changes by 180°, i.e., whether a spark has taken place. When it is determined that a spark has not take place, the CPU 30 proceeds to step 51, and otherwise it proceeds to step 52.

In step 52, the CPU multiplies the preceding value f[i−1] of the correction value f by the time constant a and the fixed coefficient w, thereby calculating the present value f[i] of the correction value f. Then in step 53, the CPU multiplies the preceding value n[i−1] of the correction value n by the time constant q and the fixed coefficient w, thereby calculating the present value n[i] of the correction value n. Further, in step 54, the CPU multiplies the preceding value v[i−1] of the correction value v by the time constant p, the coolant-temperature-based correction value r and the fixed coefficient w, thereby calculating the present value v[i] of the correction value v.

The steps 52 to 54 are for gradually returning the fuel increase during acceleration to the original state, and in this particular embodiment, these steps are executed every 180° crank angle.

In step 51, the CPU 30 adds up the present values of the correction values f, n and v, thereby obtaining a total acceleration fuel increase correction x.

Then in step 55, the CPU 30 multiplies the sum of the total acceleration fuel increase correction x and the basic fuel injection pulse width z by the basic fuel injection pulse width correction coefficient $\alpha$ and the noneffective fuel injection pulse width $\beta$ and obtains a final fuel injection pulse width by which the injector 18 is actually driven. Then the CPU 30 drives the injector 18 at a predetermined injection timing. (steps 56 and 57)

An example of change in the throttle opening tvo, the boost ce, the estimated amount of intake air qa, the sum of the correction values f and n, and the correction value v during acceleration is shown in FIG. 15.

In this particular embodiment, the correction value for correcting the amount of fuel increase according to increase in the amount of the adhering fuel is set on the basis of the throttle opening tvo, and the correction value v is set on the basis of the amount of intake air qa which is estimated on the basis of the throttle opening tvo and the engine speed Ne. This is advantageous over the case where they are set on the basis of the amount of intake air detected by an airflow meter in that delay in response of the control system can be avoided and an excellent accelerating performance can be ensured especially upon an abrupt acceleration. If the amount of intake air is detected by the airflow meter, the detected value lags behind the actual value and the response of the control system delays.

We claim:

1. A fuel control system for an engine comprising a fuel injector which injects fuel into an intake manifold of the engine, an acceleration detecting means which detects that the engine is accelerated, and a fuel injector control means which determines the amount of fuel to be injected from the fuel injector so that the sum of the amount of the direct delivery part of the injected fuel which is directly fed to a combustion chamber of the engine from the injector and the amount of the drawn part fuel which has adhered to the wall surface of the intake manifold, evaporates and then flows into the combustion chamber is a target amount of fuel to be actually fed to the combustion chamber and causes the fuel injector to inject the target amount of fuel, and determines the amount of the drawn part fuel being estimated on the basis of an estimated amount of intake manifold adhering fuel which has adhered to the wall surface of the intake manifold, and the fuel injector control means increasing the target amount of fuel when the acceleration detecting means detects that the engine is accelerated, wherein the improvement comprises:

said fuel injector control means is provided with a means for estimating the amount of part of fuel injected from the injector which part is robbed by the wall surface of the intake manifold near the injector and does not contribute to the estimated amount of intake manifold adhering fuel during acceleration, and the fuel injector control means is provided with a means for increasing the amount of fuel to be injected from the injector by an amount corresponding to the estimated amount of the part of fuel which is robbed by the wall surface of the intake manifold near the injector and does not contribute to the estimated amount of intake manifold adhering fuel.

2. A fuel control system as defined in claim 1 further including an adjustable throttling means positioned in the intake manifold having an adjustable throttle opening for adjusting the flow of a gas through the intake manifold, wherein the amount of the part of fuel which is robbed by the wall surface of the intake manifold near the injector and does not contribute to the estimated amount of intake manifold adhering fuel is estimated on the basis of the throttle opening.

3. The fuel control system of claim 1 further including an adjustable throttling means positioned in the intake manifold having an adjustable throttle opening for adjusting the flow of a gas through the intake manifold, wherein the amount of the drawn part fuel is corrected on the basis of a change in said throttle opening.

4. The fuel control system of claim 1 further including an adjustable throttling means positioned in the intake manifold having an adjustable throttle opening for adjusting the flow of gas through the intake manifold, wherein the adhering fuel amount is estimated on the basis of said throttle opening and a charging efficiency.

5. The fuel control system of claim 1, wherein the amount of the drawn part fuel is corrected on the basis of engine speed.

* * * * *